US011046078B2

(12) United States Patent
Lee et al.

(10) Patent No.: US 11,046,078 B2
(45) Date of Patent: Jun. 29, 2021

(54) METHOD OF DISCHARGING CHEMICAL LIQUID USING AN INK JET HEAD

(71) Applicant: Semes Co., Ltd., Cheonan-si (KR)

(72) Inventors: Dong Yun Lee, Cheonan-si (KR); Yoon-Ok Jang, Cheonan-si (KR); Jaehun Jung, Cheonan-si (KR)

(73) Assignee: Semes Co., Ltd., Cheonan-si (KR)

( * ) Notice: Subject to any disclaimer, the term of this patent is extended or adjusted under 35 U.S.C. 154(b) by 115 days.

(21) Appl. No.: 16/377,570

(22) Filed: Apr. 8, 2019

(65) Prior Publication Data

US 2019/0308414 A1 Oct. 10, 2019

(30) Foreign Application Priority Data

Apr. 9, 2018 (KR) ..... 10-2018-0041082

(51) Int. Cl.
*B41J 2/145* (2006.01)
*B41J 2/02* (2006.01)
*B41J 2/14* (2006.01)

(52) U.S. Cl.
CPC ..... *B41J 2/145* (2013.01); *B41J 2/02* (2013.01); *B41J 2/14* (2013.01)

(58) Field of Classification Search
CPC ..... B41J 2/145; B41J 2/15; B41J 2/51; B41J 2/02; B41J 2/14; B41J 2/04543; B41J 2/04545; B41J 2/3551
See application file for complete search history.

(56) References Cited

U.S. PATENT DOCUMENTS

2002/0063750 A1* 5/2002 Kanda ..... B41J 2/2132 347/41

FOREIGN PATENT DOCUMENTS

| | | | |
|---|---|---|---|
| KR | 10-2013-0100336 | A | 9/2013 |
| KR | 10-2016-0031201 | A | 3/2016 |
| KR | 10-2017-0080959 | A | 7/2017 |
| KR | 10-17591320000 | B1 | 7/2017 |

* cited by examiner

*Primary Examiner* — Henok D Legesse
(74) *Attorney, Agent, or Firm* — Daly, Crowley, Mofford & Durkee, LLP

(57) ABSTRACT

In a method of supplying chemical liquid using an ink jet head including a central portion and peripheral portions each having a first portion and a second portion, a first chemical liquid supply of a chemical liquid may be provided from the central portion onto a substrate, a second chemical liquid supply of the chemical liquid may be provided from the first portion onto a substrate, and a third chemical liquid supply of the chemical liquid may be provided from the second portion onto a substrate. The ink jet head may be moved over the substrate by a length of the peripheral portion. The first chemical liquid supply of the chemical liquid may be provided from the central portion onto a substrate, the second chemical liquid supply of the chemical liquid may be provided from the first portion onto a substrate, and the third chemical liquid supply of the chemical liquid may be provided from the second portion onto a substrate.

4 Claims, 2 Drawing Sheets

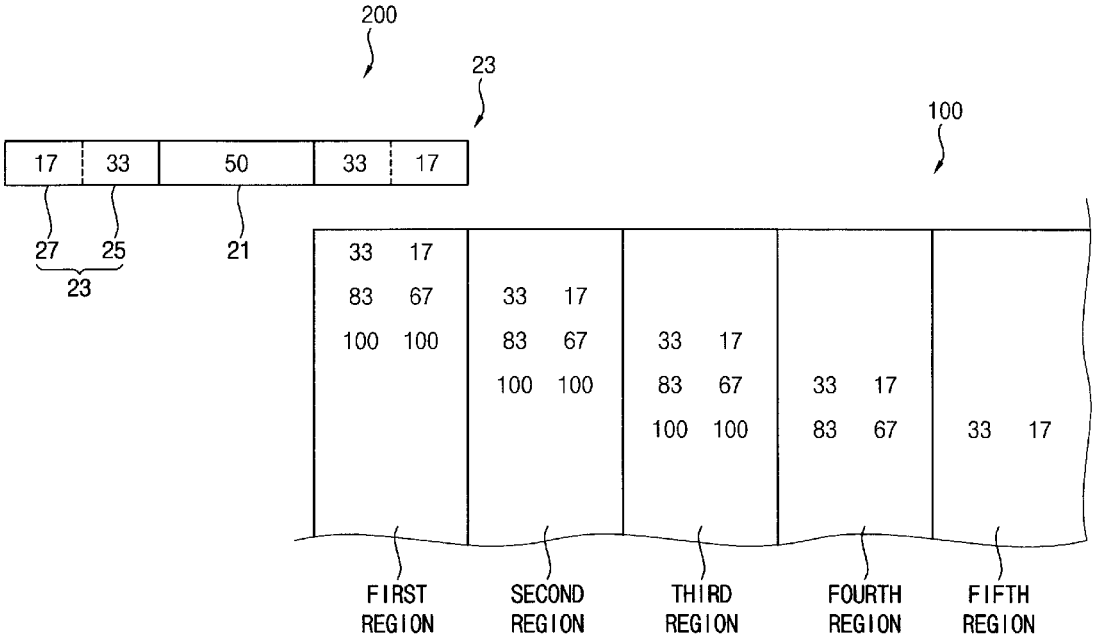
[FIG. 1]
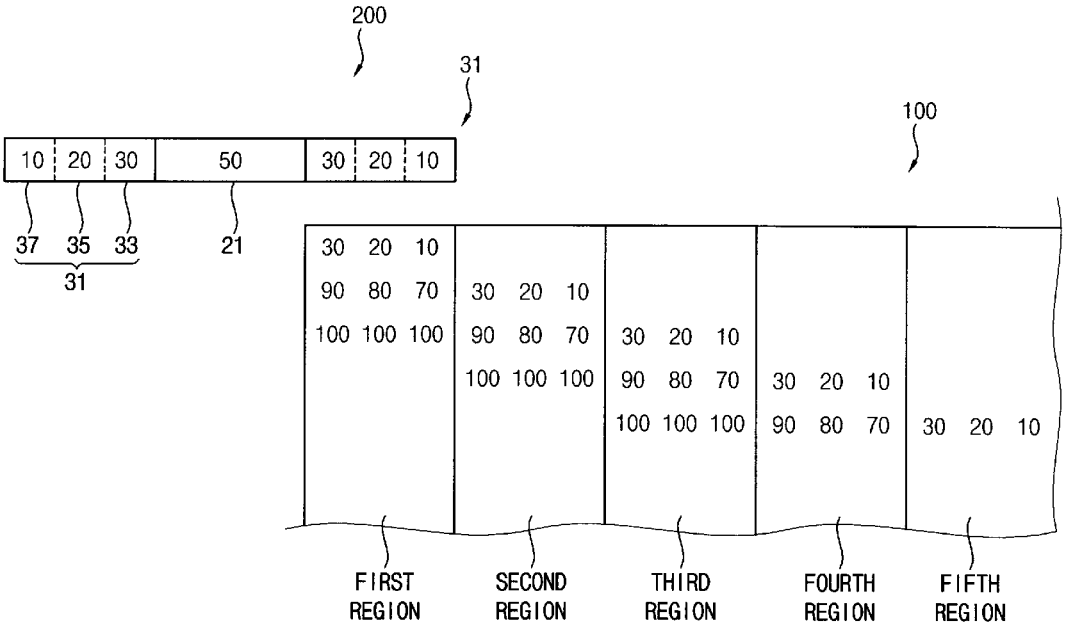
[FIG. 2]

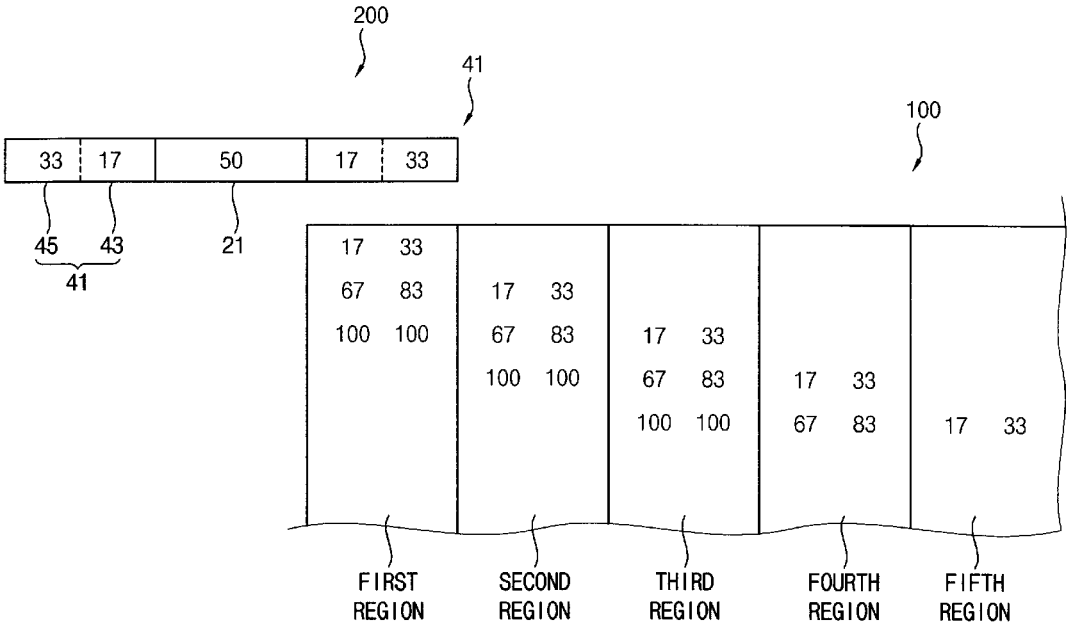
[FIG. 3]

METHOD OF DISCHARGING CHEMICAL LIQUID USING AN INK JET HEAD

CROSS-REFERENCE TO RELATED APPLICATION

This application claims a priority to Korean Patent Application No. 10-2018-0041082 filed on Apr. 9, 2018 in the Korean Intellectual Property Office (KIPO), the content of which is herein incorporated by reference in their entity.

BACKGROUND

1. Field

Example embodiments of the invention relate to methods of supplying chemical liquid using an ink jet head. More particularly, example embodiments of the invention relate to methods of supplying chemical liquid using an ink jet head which can provide chemical liquid more than twice onto a desired region.

2. Related Technology

A thin film such as an orientation layer, a color filter or an organic light emitting layer is generally formed on a substrate in processes for manufacturing a display device such as a liquid crystal display device, an organic light emitting display device, etc. Such a thin film is typically formed on the substrate using an ink jet head including a plurality of nozzles.

The conventional ink jet head includes two portions, a first portion and a second portion, where the first portion provides chemical liquid onto a predetermined region of a substrate with about 50% of a chemical liquid supply. After moving the ink jet head over the substrate by a length of the first portion, the second portion provides again the chemical liquid onto the predetermined region of a substrate with about 50% of the chemical liquid supply. In this case, excessive chemical liquid is supplied on a boundary between the predetermined region and an adjacent region. As such, when excessive chemical liquid is provided on the boundary between adjacent regions, the interfacial turbulence (also, referred to as Marangoni Effect) is caused by the chemical liquid, and thus the thin film is not be uniformly formed on the predetermined region of the substrate.

SUMMARY

It is an object of the invention to provide a method of supply chemical liquid which can provide chemical liquid of different chemical liquid supplies onto a predetermined region more than twice and can prevent the interfacial turbulence generated by chemical liquid at boundary between adjacent regions.

According to an aspect of the invention, there is provided a method of supplying chemical liquid using an ink jet head including a central portion and peripheral portions each having a first portion and a second portion. In the method of supplying chemical liquid, a first chemical liquid supply of a chemical liquid may be provided from the central portion onto a substrate, a second chemical liquid supply of the chemical liquid may be provided from the first portion onto a substrate, and a third chemical liquid supply of the chemical liquid may be provided from the second portion onto a substrate. The ink jet head may be moved over the substrate by a length of the peripheral portion. The first chemical liquid supply of the chemical liquid may be provided from the central portion onto a substrate, the second chemical liquid supply of the chemical liquid may be provided from the first portion onto a substrate, and the third chemical liquid supply of the chemical liquid may be provided from the second portion onto a substrate.

In example embodiments, the first chemical liquid supply of the chemical liquid from the central portion may be substantially the same as the sum of the second chemical liquid supply of the chemical liquid from the first portion and the third chemical liquid supply of the chemical liquid from the second portion.

In example embodiments, the first chemical liquid supply of the chemical liquid from the central portion may be substantially greater than the second chemical liquid supply of the chemical liquid from the first portion and the third chemical liquid supply of the chemical liquid from the second portion.

In example embodiments, the second chemical liquid supply of the chemical liquid from the first portion may be substantially greater than the third chemical liquid supply of the chemical liquid from the second portion.

In some example embodiments, the second chemical liquid supply of the chemical liquid from the first portion may be substantially less than the third chemical liquid supply of the chemical liquid from the second portion.

In some example embodiments, each of the peripheral portions may include a third portion and a fourth chemical liquid supply of the chemical liquid may be provided from the third portion onto the substrate.

In some example embodiments, the first chemical liquid supply of the chemical liquid from the central portion may be substantially the same as the sum of the second chemical liquid supply of the chemical liquid from the first portion, the third chemical liquid supply of the chemical liquid from the second portion and the fourth chemical liquid supply of the chemical liquid from the second portion.

In some example embodiments, the first chemical liquid supply of the chemical liquid from the central portion may be substantially greater than the second chemical liquid supply of the chemical liquid from the first portion, the third chemical liquid supply of the chemical liquid from the second portion and the fourth chemical liquid supply of the chemical liquid from the second portion.

In some example embodiments, the second chemical liquid supply of the chemical liquid from the first portion may be substantially greater than the third chemical liquid supply of the chemical liquid from the second portion, and the third chemical liquid supply of the chemical liquid from the second portion may be substantially greater than the fourth chemical liquid supply of the chemical liquid from the third portion.

In some example embodiments, the second chemical liquid supply of the chemical liquid from the first portion may be substantially less than the third chemical liquid supply of the chemical liquid from the second portion, and the third chemical liquid supply of the chemical liquid from the second portion may be substantially less than the fourth chemical liquid supply of the chemical liquid from the third portion.

According to example embodiments of the invention, the more than two peripheral portions of the ink jet head may provide the chemical liquid onto the regions of the substrate with different chemical liquid supplies. The chemical liquid may be supplied more than twice onto the regions of the substrate so that the interfacial turbulence generated by the chemical liquid at the boundary between adjacent regions of the substrate may be effectively prevented. Therefore, a desired thin film may be uniformly formed on the substrate.

BRIEF DESCRIPTION OF THE DRAWINGS

Example embodiments will be more clearly understood from the following detailed description taken in conjunction with the accompanying drawing. The following figures represent non-limiting, example embodiments as described herein.

FIG. 1 is a schematic view illustrating a method of supplying chemical liquid using an ink jet head in accordance with example embodiments of the invention.

FIG. 2 is a schematic view illustrating a method of supplying chemical liquid using an ink jet head in accordance with some example embodiments of the invention.

FIG. 3 is a schematic view illustrating a method of supplying chemical liquid using an ink jet head in accordance with other example embodiments of the invention.

DESCRIPTION OF EMBODIMENTS

Various embodiments will be described more fully hereinafter with reference to the accompanying drawings, in which some embodiments are shown. The invention may, however, be embodied in many different forms and should not be construed as limited to the embodiments set forth herein. Rather, these embodiments are provided so that this description will be thorough and complete, and will fully convey the scope of the invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (for example, rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include a plurality of forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-sectional illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the face through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, a method of supplying chemical liquid using an ink jet head according to example embodiments of the invention will be described with reference to the accompanying drawings.

The method of supplying chemical liquid may be used in processes for forming an orientation layer, a color filter or an organic light emitting layer in a display device such as a liquid crystal display device, an organic light emitting display device, etc. The method of supplying chemical liquid may be performed using an ink jet head capable of providing desired chemical liquid onto a substrate.

In example embodiments, the ink jet head may include a plurality of nozzles capable of spraying the chemical liquid onto the substrate. The plurality of nozzles of the ink jet head may be arranged by a substantially constant distance. For example, the nozzles may be disposed in a substantial line shape. The ink jet head may include a plurality of piezoelectric elements corresponding to the plurality of nozzles. The chemical liquid may be supplied onto the substrate in accordance with the operations of the piezoelectric elements. The voltages applied to the piezoelectric elements may be controlled so that the amounts of the chemical liquid supplied from the respective nozzles onto the substrate may be independently adjusted. In other words, the amounts of the chemical liquid supplied from the ink jet head onto the substrate may be adjusted by independently controlling the plurality of nozzles.

In some example embodiments, the method of supplying chemical liquid may be performed using an ink jet head unit including a plurality of ink jet heads. For example, the ink jet head may include three ink jet heads.

According to example embodiments, the ink jet head may include a central portion and peripheral portions. Here, the peripheral portions may be positioned at both sides of the central portion. The central portion may have a length substantially the same as the lengths of the peripheral portions. For example, the ink jet head may include three portions having the same lengths. In addition, the central portion and the peripheral portions may include the same number of nozzles.

According to example embodiments, each of the peripheral portions may include more than two portions. For example, the peripheral portion of the ink jet head may include a first portion contacting the central portion to an Nth (wherein N is an integer greater than 2) portion. In this case, the first portion to the N portion may have the same lengths. Additionally, the first portion to the N portion may include the same number of nozzles.

In the method of supplying chemical liquid, the central portion of the ink jet head may provide a first chemical liquid supply of the chemical liquid onto the substrate. The first portion of the peripheral portion of the ink jet head may provide a second chemical liquid supply of the chemical liquid onto the substrate and a second portion of the peripheral portion may provide a third chemical liquid supply of the chemical liquid onto the substrate. As such, the N portion of the peripheral portion may provide an N+1 chemical liquid supply of the chemical liquid onto the substrate. In this case, the first chemical liquid supply of the chemical liquid may be greater than the second chemical liquid supply of the chemical liquid and the third chemical liquid supply of the chemical liquid. For example, the first chemical liquid supply of the chemical liquid may be substantially the same as the sum of the second chemical liquid supply of the chemical liquid and the third chemical liquid supply of the chemical liquid. In addition, the second chemical liquid supply of the chemical liquid may be greater than the third chemical liquid supply of the chemical liquid. Alternatively, the second chemical liquid supply of the chemical liquid may be less than the third chemical liquid supply of the chemical liquid.

In some example embodiments, each of the peripheral portions of the ink jet head may include a first portion, a second portion and a third portion. The first portion may provide the chemical liquid of a second chemical liquid supply of the chemical liquid onto the substrate, the second portion may provide the chemical liquid of a third chemical liquid supply of the chemical liquid onto the substrate, and the third portion may provide the chemical liquid of a fourth chemical liquid supply of the chemical liquid onto the substrate. Here, the second chemical liquid supply of the chemical liquid may be greater than the third chemical liquid supply of the chemical liquid and the third chemical liquid supply of the chemical liquid may be greater than the fourth chemical liquid supply of the chemical liquid. Alternatively, the second chemical liquid supply of the chemical liquid may be less than the third chemical liquid supply of the chemical liquid and the third chemical liquid supply of the chemical liquid may be less than the fourth chemical liquid supply of the chemical liquid. Additionally, the first chemical liquid supply of the chemical liquid from the central portion may be greater than the second chemical liquid supply of the chemical liquid, the third chemical liquid supply of the chemical liquid and the fourth chemical liquid supply of the chemical liquid. For example, the first chemical liquid supply of the chemical liquid may be substantially the same as the sum of the second chemical liquid supply of the chemical liquid, the third chemical liquid supply of the chemical liquid and the fourth chemical liquid supply of the chemical liquid. In other words, the first chemical liquid supply of the chemical liquid may be substantially the same as the sum of the second chemical liquid supply of the chemical liquid to the N+1 chemical liquid supply of the chemical liquid when the peripheral portion includes the first portion to the N portion.

The ink jet head may supplies the chemical liquid onto the substrate in a scan manner along a direction substantially perpendicular to the length of the peripheral portion. Then, the ink jet head may be moved over the substrate by a length of the peripheral portion. For example, the ink jet head may move over the substrate by about one-third of the total length of the ink jet head when the length of the central portion is substantially the same as the length of the peripheral portion.

In the method of supplying chemical liquid according to example embodiments, each of the peripheral portions of the ink jet head may include more than two portions. The central portion and the more than two portions of the peripheral portion may provide the chemical liquid of different chemical liquid supplies more than twice onto a predetermined region of the substrate so that excessive chemical liquid may not be supplied onto a boundary between adjacent regions of the substrate. Accordingly, interfacial turbulence caused by the chemical liquid at the boundary between adjacent regions may be prevented to thereby uniformly form a thin film having desired thickness on the substrate.

Hereinafter, a method of supplying chemical liquid using an ink jet head according to example embodiments will be described in detail with reference to the accompanying drawings.

FIG. 1 is a schematic view illustrating a method of supplying chemical liquid using an ink jet head in accordance with example embodiments of the invention.

Referring to FIG. 1, the method of supplying chemical liquid according to example embodiments may be performed using an ink jet head 200 capable of providing chemical liquid onto a substrate 100. The ink jet head 200 may include a central portion 21 and peripheral portions 23 positioned at both sides of the central portion 21. Each of the peripheral portions 23 may include a first portion 24 and a second portion 27. The first portion 25 may be positioned to be contacted with the central portion 21. In example embodiments, the central portion 21 of the ink jet head 200 may provide about 50% of a chemical liquid supply provided onto a substrate 100 in a predetermined process. Additionally, the first portion 25 of the peripheral portion 23 may provide about 33% or about 17% of the chemical liquid supply onto the substrate 100, and the second portion 27 of the peripheral portion 23 may provide about 17% or about 33% of the chemical liquid supply onto the substrate 100.

In the method of supply chemical liquid according to example embodiments, one peripheral portion 23 of the ink jet head 200 may be placed over a first region of the substrate 100, and then the chemical liquid may be supplied onto the first region of the substrate 100 by driving the ink jet head 200 in a scan manner. Here, the central portion 21 and the other peripheral portion 23 of the ink jet head 200 may be deviated from the substrate 100 so that the chemical liquid may not be supplied from the central portion 21 and the other peripheral portion 23. At this time, the first portion 25 of the one peripheral portion 23 may provide about 33% of the chemical liquid supply onto the first region of the substrate 100, and the second portion 25 of the one peripheral portion 23 may provide about 17% of the chemical liquid supply onto the first region.

Then, the ink jet head 200 may move over the substrate 100 by a length of the one peripheral portion 23. Thus, the one peripheral portion 23 of the ink jet head 200 may be placed over a second region of the substrate 100 and the central portion 21 of the ink jet head 200 may be located over the first region of the substrate 100. After the one peripheral portion 23 and the central portion 21 of the ink jet head 200 are placed over the second region and the first region of the substrate 100, respectively, the chemical liquid may be provided onto the second region and the first region by driving the ink jet head 200 in the scan manner. Here, the chemical liquid may not be provided from the other peripheral portion 23 of the ink jet head 200 because the other peripheral portion 23 may be deviated from the substrate 100.

The first portion 25 of the one peripheral portion 23 may provide about 33% of the chemical liquid supply onto the second region of the substrate 100, and the second portion 27 of the one peripheral portion 23 may provide about 17% of the chemical liquid supply onto the second region. Additionally, the central portion 21 may provide about 50% of the chemical liquid supply onto the first region of the substrate 100. Therefore, based on the accumulation amount of the chemical liquid supply, about 17% of the chemical liquid supply from the second portion 27 of the one peripheral portion 23 and about 33% of the chemical liquid supply from the first portion 25 of the one peripheral portion 23 may be supplied onto the second region of the substrate 100. Further, about 83% of the chemical liquid supply from the central portion 21 and the first portion 25 of the one peripheral portion 23 plus about 67% of the chemical liquid supply from the central portion 21 and the second portion 27 of the one peripheral portion 23 may be provided on the first region of the substrate 100.

Then, the ink jet head 200 may move over the substrate 100 by the length of the one peripheral portion 23. Hence, the one peripheral portion 23 of the ink jet head 200 may be placed over a third region of the substrate 100, the central portion 21 of the ink jet head 200 may be located over the second region of the substrate 100, and the other peripheral portion 23 of the ink jet head 200 may be placed over the first region of the substrate 100. After the one peripheral portion 23, the central portion 21 and the other peripheral portion 23 of the ink jet head 200 are placed over the third region, the second region and the first region of the substrate 100, respectively, the chemical liquid may be provided onto the third region, the second region and the first region of the substrate 100.

The first portion 25 of the one peripheral portion 23 may provide about 33% of the chemical liquid supply onto the third region, and the second portion 27 of the one peripheral portion 23 may provide about 17% of the chemical liquid supply onto the third region. The central portion 21 may provide about 50% of the chemical liquid supply onto the second region. The first portion 25 of the other peripheral portion 23 may provide about 33% of the chemical liquid supply onto the first region, and the second portion 27 of the other peripheral portion 23 may provide about 17% of the chemical liquid supply onto the first region. Therefore, based on the accumulation amount of the chemical liquid, about 33% of the chemical liquid supply from the first portion 25 of the one peripheral portion 23 and about 17% of the chemical liquid supply from the second portion 27 of the one peripheral portion 23 may be provided onto the third region of the substrate 100. Further, about 83% of the chemical liquid supply from the first portion 25 of the one peripheral portion 23 and the central portion 21 plus about 67% of the chemical liquid supply from the second portion 27 of the one peripheral portion 23 and the central portion 21 may be provided onto the second region of the substrate 100. Moreover, about 100% of the chemical liquid supply from the first portion 25 of the one peripheral portion 23, the central portion 21 and the second portion 27 of the other peripheral portion 23 plus about 100% of the chemical liquid supply from the second portion 27 of the one peripheral portion 23, the central portion 21 and the first portion 25 of the other peripheral portion 23 may be provided onto the first region of the substrate 100.

The ink jet head 200 may be moved over the substrate 100, and then the one peripheral portion 23, the central portion 21 and the other peripheral portion 23 of the ink jet head 200 may provide the chemical liquid onto a fourth region, the third region and the second region of the substrate 100, respectively, as above-described manner. Therefore, based on the accumulation amount of the chemical liquid, about 33% of the chemical liquid supply from the first portion 25 of the one peripheral portion 23 and about 17% of the chemical liquid supply from the second portion 27 of the one peripheral portion 23 may be provided onto the fourth region of the substrate 100. Additionally, about 83% of the chemical liquid supply from the first portion 25 of the one peripheral portion 23 and the central portion 21 plus about 67% of the chemical liquid supply from the second portion 27 of the one peripheral portion 23 and the central portion 21 may be provided onto the third region of the substrate 100. Further, about 100% of the chemical liquid supply from the first portion 25 of the one peripheral portion 23, the central portion 21 and the second portion 27 of the other peripheral portion 23 plus about 100% of the chemical liquid supply from the second portion 27 of the one peripheral portion 23, the central portion 21 and the first portion 25 of the other peripheral portion 23 may be provided onto the second region of the substrate 100.

Similarly, the chemical liquid may be provided onto a fifth region, the fourth region and the third region of the substrate 100 from the one peripheral portion 22, and the central portion 21 and the other peripheral portion 23 of the ink jet head 200, respectively, as above-described manner. Therefore, based on the accumulation amount of the chemical liquid, about 33% of the chemical liquid supply from the first portion 25 of the one peripheral portion 23 and about 17% of the chemical liquid supply from the second portion 27 of the one peripheral portion 23 may be provided onto the fifth region of the substrate 100. Further, about 83% of the chemical liquid supply from the first portion 25 of the one peripheral portion 23 and the central portion 21 plus about 67% of the chemical liquid supply from the second portion 27 of the one peripheral portion 23 and the central portion 21 may be provided onto the fourth region of the substrate 100. Moreover, about 100% of the chemical liquid supply from the first portion 25 of the one peripheral portion 23, the central portion 21 and the second portion 27 of the other peripheral portion 23 plus about 100% of the chemical liquid supply from the second portion 27 of the one peripheral portion 23, the central portion 21 and the first portion 25 of the other peripheral portion 23 may be provided onto the third region of the substrate 100.

In the method of supplying chemical liquid according to example embodiments, as described above, more than two peripheral portions 23 of the ink jet head 200 may provide the chemical liquid onto the regions of the substrate 100 with different chemical liquid supplies. The chemical liquid may be supplied more than twice onto the regions of the substrate 100 so that the interfacial turbulence generated by the chemical liquid at the boundary between adjacent regions of the substrate 100 may be effectively prevented. Therefore, a desired thin film may be uniformly formed on the substrate 100.

FIG. 2 is a schematic view illustrating a method of supplying chemical liquid using an ink jet head in accordance with some example embodiments of the invention. In FIG. 2, the elements the same as or similar to the elements described in FIG. 1 may be indicated by the same or similar reference numerals.

Referring to FIG. 2, an ink jet head 200 may include a central portion 21 and peripheral portions 23, where each of the peripheral portions 23 may include a first third portion 37, a second portion 35 and a first portion 33 from the central portion 21. In the method of supplying chemical liquid according to some example embodiments, the central portion 21 of the ink jet head 200 may provide about 50% of a chemical liquid supply onto a substrate 100. The first portion 33 of the peripheral portion 31 of the ink jet head 200 may provide about 30% or about 10% of the chemical liquid supply onto the substrate 100, the second portion 35 of the peripheral portion 31 may provide about 20% of the chemical liquid supply onto the substrate 100, and the third portion 37 of the peripheral portion 31 may provide about 10% or about 30% of the chemical liquid supply onto the substrate 100.

One peripheral portion 31 of the ink jet head 200 may be placed over a first region of the substrate 100, and then chemical liquid may be provided onto the first region of the substrate 100 by driving the ink jet head 200 in a scan manner. In this case, the central portion 21 and the other peripheral portion 31 of the ink jet head 200 may not provide the chemical liquid onto the substrate 100 because the central portion 21 and the other peripheral portion 31 may deviate from the substrate 100.

The third portion 37 of the one peripheral portion 31 may provide about 10% of the chemical liquid supply onto the first region of the substrate 100, the second portion 35 of the one peripheral portion 31 may provide about 20% of the chemical liquid supply onto the first region, and the first portion 33 of the one peripheral portion 31 may provide about 30% of the chemical liquid supply onto the first region Then, the ink jet head 200 may be moved over the substrate 100 by a length of the one peripheral portion 31 such that the one peripheral portion 31 may be placed over a second region of the substrate 100 and the central portion 21 may be located over the first region of the substrate 100. After placing the one peripheral portion 31 and the central portion 21 over the second region and the first region, respectively, the chemical liquid may be provided onto the first region and the second region of the substrate 100. Here, the other peripheral portion 31 of the ink jet head 200 may not provide the chemical liquid onto the substrate 100 since the other peripheral portion 31 may deviate from the substrate 100.

The third portion 37 of the one peripheral portion 31 may provide about 10% of the chemical liquid supply onto the second region of the substrate 100, the second portion 35 of the one peripheral portion 31 may provide about 20% of the chemical liquid supply onto the second region, and the first portion 33 of the one peripheral portion 31 may provide about 30% of the chemical liquid supply onto the second region. The central portion 21 may provide about 50% of the chemical liquid supply onto the second region. Therefore, based on the accumulation amount of the chemical liquid, about 10% of the chemical liquid supply from the third portion 37 of the one peripheral portion 31, about 20% of the chemical liquid supply from the second portion 35 of the one peripheral portion 31, and about 30% of the chemical liquid supply from the first portion 33 of the one peripheral portion 31 may be provided onto the second region of the substrate 100. Additionally, onto the first region of the substrate 100, about 70% of the chemical liquid supply from the third portion 37 of the one peripheral portion 31 and the central portion 21 plus about 80% of the chemical liquid supply from the second portion 35 of the one peripheral portion 31 and the central portion 21 plus about 90% of the chemical liquid supply from the first portion 33 of the one peripheral portion 31 and the central portion 21 may be provided.

Then, the ink jet head 200 may be moved over the substrate 100 by the length of the one peripheral portion 31 such that the one peripheral portion 31 may be located over a third region of the substrate 100, the central portion 21 may be placed over the second region of the substrate 100, and the other peripheral portion 31 may be placed over the first region of the substrate 100. The chemical liquid may be supplied from the one peripheral portion 21, the central portion 21 and the other peripheral portion 31 of the ink jet head 200 onto the third region, the second region and the first region of the substrate 100, respectively.

The third portion 37 of the one peripheral portion 21 may provide about 10% of the chemical liquid supply onto the third region of the substrate 100, the second third portion 35 of the one peripheral portion 21 may provide about 20% of the chemical liquid supply onto the third region, and the first third portion 33 of the one peripheral portion 21 may provide about 10% of the chemical liquid supply onto the third region. Additionally, the central portion 21 may provide about 60% of the chemical liquid supply onto the second region. Furthermore, the first portion 33 of the other peripheral portion 31 may provide about 30% of the chemical liquid supply onto the first region, the second portion 35 of the other peripheral portion 31 may provide about 20% of the chemical liquid supply onto the first region, and the third portion 37 of the other peripheral portion 31 may provide about 10% of the chemical liquid supply onto the first region. Therefore, based on the accumulation amount of the chemical liquid, about 10% of the chemical liquid supply from the third portion 37 of the one peripheral portion 31, about 20% of the chemical liquid supply from the second portion 35 of the one peripheral portion 31 and about 30% of the chemical liquid supply from the first portion 37 of the one peripheral portion 31 may be provided onto the third region of the substrate 100. Further, about 70% of the chemical liquid supply from the third portion 37 of the one peripheral portion 31 and the central portion 21 plus about 80% of the chemical liquid supply from the second portion 35 of the one peripheral portion 31 plus about 90% of the chemical liquid supply from the first portion 33 of the one peripheral portion 31 and the central portion 21 may be provided onto the second region of the substrate 100. Moreover, about 100% of the chemical liquid supply from the third portion 37 of the one peripheral portion 31, the central portion 21 and the first portion 37 of the other peripheral portion 31 plus about 100% of the chemical liquid supply from the second portion 35 of the one peripheral portion 31, the central portion 21 and the second portion 35 of the other peripheral portion 31 plus about 100% of the chemical liquid supply from the first portion 33 of the one peripheral portion 31, the central portion 21 and the third portion 37 of the other peripheral portion 31 may be provided onto the first region of the substrate 100.

After moving the ink jet head 200 over the substrate 100, the chemical liquid may supplied onto a fourth region, the third region and the second region of the substrate 100 as described above. Accordingly, based on the accumulation amount of the chemical liquid, the third portion 37 of the one peripheral portion 31 may provide about 10% of the chemical liquid supply onto the fourth region of the substrate 100, the second portion 35 of the one peripheral portion 31 may provide about 20% of the chemical liquid supply onto the fourth region, and the first portion 33 of the one peripheral portion 31 may provide about 30% of the chemical liquid supply onto the fourth region. In addition, about 70% of the chemical liquid supply from the third portion 37 of the one peripheral portion 31 and the central portion 21 plus about 80% of the chemical liquid supply from the second portion 35 of the one peripheral portion 31 and the central portion 21 plus about 90% of the chemical liquid supply from the first portion 33 of the one peripheral portion 31 and the central portion 21 may be provided onto the third region of the substrate 100. Furthermore, about 100% of the chemical liquid supply from the third portion 37 of the one peripheral portion 31, the central portion 21 and the first portion 33 of the other peripheral portion 31 plus about 100% of the chemical liquid supply from the second portion 35 of the one peripheral portion 31, the central portion 21 and the second portion 35 of the other peripheral portion 31 plus about 100% of the chemical liquid supply from the first portion 33 of the one peripheral portion 31, the central portion 21 and the third portion 37 of the other peripheral portion 31 may be provided onto the second region of the substrate 100.

The ink jet head 200 may be moved over the substrate 100, and then the chemical liquid may supplied onto a fifth region, the fourth region and the third region of the substrate 100 as described above. As a result, about 10% of the chemical liquid supply from the third portion 37 of the one peripheral portion 31 plus about 20% of the chemical liquid supply from the second portion 35 of the one peripheral portion 31 plus about 30% of the chemical liquid supply from the first portion 33 of the one peripheral portion 31 may be provided onto the fifth region of the substrate 100. Additionally, about 70% of the chemical liquid supply from the third portion 37 of the one peripheral portion 31 and the central portion 21 plus about 80% of the chemical liquid supply from the second portion 35 of the one peripheral portion 31 and the central portion 21 plus about 90% of the chemical liquid supply from the first portion 33 of the one peripheral portion 31 and the central portion 21 may be provided onto the fourth region of the substrate 100. Furthermore, about 100% of the chemical liquid supply from the third portion 37 of the one peripheral portion 31, the central portion 21 and the first portion 33 of the other peripheral portion 31 plus about 100% of the chemical liquid supply from the second portion 35 of the one peripheral portion 31, the central portion 21 and the second portion 35 of the other peripheral portion 31 plus about 100% of the chemical liquid supply from the first portion 33 of the one peripheral portion 31, the central portion 21 and the third portion 37 of the other peripheral portion 31 may be provided onto the third region of the substrate 100.

In the method of supplying chemical liquid according to some example embodiments, more than three peripheral portions 31 of the ink jet head 200 may provide the chemical liquid onto the regions of the substrate 100 with different chemical liquid supplies. The chemical liquid may be supplied more than three times onto the regions of the substrate 100 such that the interfacial turbulence generated by the chemical liquid at the boundary between adjacent regions of the substrate 100 may be more effectively prevented. Therefore, a desired thin film may be more uniformly formed on the substrate 100.

FIG. 3 is a schematic view illustrating a method of supplying chemical liquid using an ink jet head in accordance with other example embodiments of the invention. In FIG. 3, the elements the same as or similar to the elements described in FIGS. 1 and 2 may be indicated by the same or similar reference numerals.

Referring to FIG. 3, an ink jet head 200 may include a central portion 21 and peripheral portions 41 where the central portion 21 may provide about 50% of chemical liquid supply onto a substrate 100, a first portion 43 of each peripheral portion 41 may provide about 17% or about 33% of chemical liquid supply onto the substrate 100, and a second portion 45 of each peripheral portion 41 may provide about 33% or about 17% of chemical liquid supply onto the substrate 100.

After placing one peripheral portion 41 of the ink jet head 200 over a first region of the substrate 100, chemical liquid may be provided from the one peripheral portion 41 onto the first region. Here, the central portion 21 and the other peripheral portion 41 of the ink jet head 200 may deviate from the substrate 100 so that the central portion 21 and the other peripheral portion 41 may not provide the chemical liquid onto the substrate 100. The second portion 45 of the one peripheral portion 41 may provide about 33% of the chemical liquid supply onto the first region of the substrate 100, and the first portion 43 of the one peripheral portion 41 may provide about 17% of the chemical liquid supply onto the first region.

The ink jet head 200 may be moved over the substrate 100 such that the one peripheral portion 41 of the ink jet head 200 may be positioned over a second region of the substrate 100 and the central portion 21 of the ink jet head 200 may be placed over the first region of the substrate 100. The chemical liquid may be supplied onto the first region and the second region of the substrate 100 by driving the ink jet head 200 in a scan manner. In this case, the other peripheral portion 41 of the ink jet head 200 may deviate from the substrate 100, and thus the other peripheral portion 41 may not provide the chemical liquid onto the substrate 100.

The second portion 45 of the one peripheral portion 41 may provide about 33% of the chemical liquid supply onto the second region of the substrate 100, and the first portion 43 of the one peripheral portion 41 may provide about 17% of the chemical liquid supply onto the second region. In addition, the central portion 21 may provide about 50% of the chemical liquid supply onto the first region of the substrate 100. As a result, based on the accumulation amount of the chemical liquid, about 33% of the chemical liquid supply from the second portion 45 of the one peripheral portion 41 plus about 17% of the chemical liquid supply from the first portion 43 of the one peripheral portion 41 may be provided onto the second region of the substrate 100. Further, about 83% of the chemical liquid supply from the second portion 45 of the one peripheral portion 41 and the central portion 21 plus about 67% of the chemical liquid supply from the first portion 43 of the one peripheral portion 41 and the central portion 21 may be provided onto the first region of the substrate 100.

The ink jet head 200 may be moved over the substrate 100 such that the one peripheral portion 41 may be placed over a third region of the substrate 100, the central portion 21 may be positioned over the second region of the substrate 100, and the other peripheral portion 41 may be placed over the first region of the substrate 100. After placing the one peripheral portion 41, the central portion 21 and the other peripheral portion 41 over the third region, the second region and the first region, respectively, the chemical liquid may be supplied onto the third region, the second region and the first region.

The second portion 45 of the one peripheral portion 41 may provide about 33% of the chemical liquid supply onto the third region of the substrate 100, and the first portion 43 of the one peripheral portion 41 may provide about 17% of the chemical liquid supply onto the third region. The central portion 21 may provide about 50% of the chemical liquid supply onto the second region of the substrate 100. The second portion 45 of the other peripheral portion 41 may provide about 33% of the chemical liquid supply onto the first region of the substrate 100, and the first portion 43 of the other peripheral portion 41 may provide about 17% of the chemical liquid supply onto the first region. As a result, based on the accumulation amount of the chemical liquid, about 33% of the chemical liquid supply from the second portion 45 of the one peripheral portion 41 plus about 17% of the chemical liquid supply from the first portion 43 of the one peripheral portion 41 may be provided onto the third region of the substrate 100. About 83% of the chemical liquid supply from the second portion 45 of the one peripheral portion 41 and the central portion 21 plus about 67% of the chemical liquid supply from the first portion 43 of the one peripheral portion 41 and the central portion 21 may be provided onto the second region of the substrate 100. About 100% of the chemical liquid supply from the second portion 45 of the one peripheral portion 41, the central portion 21 and the first portion 43 of the other peripheral portion 41 plus about 100% of the chemical liquid supply from the first portion 45 of the one peripheral portion 41, the central portion 21 and the second portion 45 of the other peripheral portion 41 may be provided onto the first region of the substrate 100.

After moving the ink jet head 200 over the substrate 100, the chemical liquid may be supplied onto a fourth region, the third region and the second region of the substrate 100. As a result, based on the accumulation amount of the chemical liquid, about 33% of the chemical liquid supply from the second portion 45 of the one peripheral portion 41 plus about 17% of the chemical liquid supply from the first portion 43 of the one peripheral portion 41 may be provided onto the fourth region of the substrate 100. About 83% of the chemical liquid supply from the second portion 45 of the one peripheral portion 41 and the central portion 21 plus about 67% of the chemical liquid supply from the first portion 43 of the one peripheral portion 41 and the central portion 21 may be provided onto the third region of the substrate 100. About 100% of the chemical liquid supply from the second portion 45 of the one peripheral portion 41, the central portion 21 and the first portion 43 of the other peripheral portion 41 plus about 100% of the chemical liquid supply from the first portion 45 of the one peripheral portion 41, the central portion 21 and the second portion 45 of the other peripheral portion 41 may be provided onto the second region of the substrate 100.

The chemical liquid may be supplied onto a fifth region, the fourth region and the third region of the substrate 100 after moving the ink jet head 200 over the substrate 100. As a result, based on the accumulation amount of the chemical liquid, about 33% of the chemical liquid supply from the second portion 45 of the one peripheral portion 41 plus about 17% of the chemical liquid supply from the first portion 43 of the one peripheral portion 41 may be provided onto the fifth region of the substrate 100. About 83% of the chemical liquid supply from the second portion 45 of the one peripheral portion 41 and the central portion 21 plus about 67% of the chemical liquid supply from the first portion 43 of the one peripheral portion 41 and the central portion 21 may be provided onto the fourth region of the substrate 100. About 100% of the chemical liquid supply from the second portion 45 of the one peripheral portion 41, the central portion 21 and the first portion 43 of the other peripheral portion 41 plus about 100% of the chemical liquid supply from the first portion 45 of the one peripheral portion 41, the central portion 21 and the second portion 45 of the other peripheral portion 41 may be provided onto the third region of the substrate 100.

In the method of supplying chemical liquid according to other example embodiments, more than two peripheral portions 41 of the ink jet head 200 may provide the chemical liquid onto the regions of the substrate 100 with different chemical liquid supplies more than three times. The interfacial turbulence generated by the chemical liquid at the boundary between adjacent regions of the substrate 100 may be effectively prevented, and thus a desired thin film may be uniformly formed on the substrate 100.

The method of supplying chemical liquid according to example embodiments may be advantageously used in processes for forming an orientation layer, a color filter or an organic light emitting layer of a display device such as a liquid crystal display device, an organic light emitting display device, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A method of supplying chemical liquid using an ink jet head including a central portion and peripheral portions each having a first portion, second portion, and a third portion, which comprises:

discharging a first chemical liquid supply of a chemical liquid from the central portion onto a substrate, discharging a second chemical liquid supply of the chemical liquid from the first portion onto the substrate, discharging a third chemical liquid supply of the chemical liquid from the second portion onto the substrate, and discharging a fourth chemical liquid supply of the chemical liquid from the third portion onto the substrate;

moving the ink jet head over the substrate by a length of the peripheral portion; and discharging the first chemical liquid supply of the chemical liquid from the central portion onto the substrate, discharging the second chemical liquid supply of the chemical liquid from the first portion onto the substrate, discharging the third chemical liquid supply of the chemical liquid from the second portion onto the substrate, and discharging the fourth chemical liquid supply of the chemical liquid from the third portion onto the substrate, wherein the first chemical liquid supply of the chemical liquid from the central portion is greater than the second chemical liquid supply of the chemical liquid from the first portion, the second chemical liquid supply of the chemical liquid from the first portion is greater than the third chemical liquid supply of the chemical liquid from the second portion, and the third chemical liquid supply of the chemical liquid from the second portion is greater than the fourth chemical liquid supply of the chemical liquid from the third portion.

2. The method of supplying chemical liquid of claim 1, wherein the first chemical liquid supply of the chemical liquid from the central portion is the same as a sum of the second chemical liquid supply of the chemical liquid from the first portion and the third chemical liquid supply from the second portion.

3. The method of supplying chemical liquid of claim 1, wherein the first chemical liquid supply of the chemical liquid from the central portion is the same as a sum of the second chemical liquid supply of the chemical liquid from the first portion, the third chemical liquid supply of the chemical liquid from the second portion and the fourth chemical liquid supply of the chemical liquid from the third portion.

4. A method of supplying chemical liquid using an ink jet head including a central portion and peripheral portions each having a first portion, a second portion, and a third portion, which comprises:

discharging a first chemical liquid supply of a chemical liquid from the central portion onto a substrate, discharging a second chemical liquid supply of the chemical liquid from the first portion onto the substrate, discharging a third chemical liquid supply of the chemical liquid from the second portion onto the substrate, discharging a fourth chemical liquid supply of the chemical liquid from the third portion onto the substrate;

moving the ink jet head over the substrate by a length of the peripheral portion; and discharging the first chemical liquid supply of the chemical liquid from the central portion onto the substrate, discharging the second chemical liquid supply of the chemical liquid from the first portion onto the substrate, discharging the third chemical liquid supply of the chemical liquid from the second portion onto the substrate, and discharging the fourth chemical liquid supply of the chemical liquid from the third portion onto the substrate, wherein the first chemical liquid supply of the chemical liquid from the central portion is greater than the second chemical liquid supply of the chemical liquid from the first portion, the second chemical liquid supply of the chemical liquid from the first portion is less than the third chemical liquid supply of the chemical liquid from the second portion, and the third chemical liquid supply of the chemical liquid from the second portion is less than the fourth chemical liquid supply of the chemical liquid from the third portion.

* * * * *